US008284980B2

(12) United States Patent
Parker et al.

(10) Patent No.: US 8,284,980 B2
(45) Date of Patent: Oct. 9, 2012

(54) LOW-PROFILE, RETRACTABLE EARBUD STORAGE SYSTEM

(76) Inventors: Matthew D. Parker, Ann Arbor, MI (US); William S. Parker, Ann Arbor, MI (US)

( * ) Notice: Subject to any disclaimer, the term of this patent is extended or adjusted under 35 U.S.C. 154(b) by 151 days.

(21) Appl. No.: 12/434,704

(22) Filed: May 4, 2009

(65) Prior Publication Data

US 2011/0170732 A1 Jul. 14, 2011

Related U.S. Application Data

(60) Provisional application No. 61/049,983, filed on May 2, 2008.

(51) Int. Cl.
*H04R 25/00* (2006.01)

(52) U.S. Cl. ..... 381/384; 381/370; 381/380

(58) Field of Classification Search ..... 381/370, 381/374, 379–380, 383–384
See application file for complete search history.

(56) References Cited

U.S. PATENT DOCUMENTS

| | | | | |
|---|---|---|---|---|
| 4,942,617 | A * | 7/1990 | Boylan | 381/384 |
| D359,487 | S | 6/1995 | Brown | |
| 5,422,957 | A * | 6/1995 | Cummins | 381/384 |
| 5,718,310 | A | 2/1998 | Gallo | |
| 6,578,683 | B1 | 6/2003 | Burke et al. | |
| 6,616,080 | B1 | 9/2003 | Edwards et al. | |
| 6,658,130 | B2 * | 12/2003 | Huang | 381/384 |
| 7,086,512 | B2 | 8/2006 | Shack et al. | |
| 7,308,109 | B2 * | 12/2007 | Jeong et al. | 381/384 |
| 2005/0245234 | A1 | 11/2005 | Stopek | |
| 2007/0041582 | A1 | 2/2007 | Lam | |
| 2007/0053541 | A1 | 3/2007 | Kuo | |
| 2007/0091557 | A1 | 4/2007 | Kim et al. | |
| 2007/0249411 | A1 | 10/2007 | Hyatt | |

FOREIGN PATENT DOCUMENTS

| | | |
|---|---|---|
| WO | WO-99/25152 | 5/1999 |

* cited by examiner

*Primary Examiner* — Suhan Ni
(74) *Attorney, Agent, or Firm* — Gifford, Krass, Sprinkle, Anderson & Citkowski, P.C.

(57) ABSTRACT

A low-profile, retractable ear-bud system is adapted for attachment to a portable electronic device such as an MP3 music player. The system comprises a housing within which there is disposed wiring having a proximal end in electrical communication with the portable electronic device and a distal end terminating in a pair of ear-buds. The wiring is wound on a spring-biased spool disposed within the housing, the spool having at least a retracted position for storage and an extended position for use of the ear-buds. In the preferred embodiment, the wiring is wound on the spring-biased spool in a single pancake-style layer. The proximal end of the wiring is in electrical communication with the portable electronic device preferably through a multi-conductor slip ring.

7 Claims, 3 Drawing Sheets

LOW-PROFILE, RETRACTABLE EARBUD STORAGE SYSTEM

REFERENCE TO RELATED APPLICATION

This application claims priority to U.S. Provisional Patent Application Ser. No. 61/049,983, filed May 2, 2008, the entire content of which is incorporated herein by reference.

FIELD OF THE INVENTION

This invention relates generally to portable electronic devices and, in particular, to a low-profile, retractable ear-bud storage system.

BACKGROUND OF THE INVENTION

The use of portable audio devices has become increasingly more common among children and adults alike. While these devices provide a very real advantage to those wishing to enjoy music, browse the Internet, or store digital media of any kind, their design leaves little room for the convenient and reliable housing of another crucial element in their use, that of wired audio headphones.

Due in large part to their often slim design, portable audio devices such as MP3 players have little room for the storage of headphones. In keeping with the portable nature of most MP3 players, accompanying headphones are often found in the "ear-bud" style. This allows for light weight, but also for ease of use while still providing excellent audio clarity in an economic package.

Yet the design of most portable MP3 players and ear-bud style headphones when used in tandem, result in one design hindering the other. Portable MP3 players are often designed to be as slim and ergonomic as possible, while ear-bud headphones are designed to be as light weight and functional as possible while still tethered to an audio device. Often enough the combination of both devices results in the headphone cord becoming tangled when stored between listening sessions. The headphone cord by nature is long enough to reach both the portable audio device and the listener, but in between listening sessions it must be stored in some manner, usually wrapped around one's hand or the audio device itself. When the ear-bud cord is wound in such a way, the headphone wires can not only become damaged, but tangles are inadvertently created.

Earlier inventions surrounding the storage of ear bud headphones have been proposed, yet they do not preserve the slim design of most modern portable audio devices, being either detached from the audio device, or bulky in nature, or both.

Therefore, a better means of storing the ear bud style headphones appear necessary for use with portable audio devices such as MP3 players or the popular "ipod" type devices available from Apple Computer of Cupertino, Calif.

SUMMARY OF THE INVENTION

This invention resides in a low-profile, retractable ear-bud system adapted for attachment to a portable electronic device such as an MP3 music player. The system comprises a housing within which there is disposed wiring having a proximal end in electrical communication with the portable electronic device and a distal end terminating in a pair of ear-buds. The wiring is wound on a spring-biased spool disposed within the housing, the spool having at least a retracted position for storage and an extended position for use of the ear-buds.

In the preferred embodiment, the wiring is wound on the spring-biased spool in a single pancake-style layer. The proximal end of the wiring is in electrical communication with the portable electronic device preferably through a multi-conductor slip ring.

DETAILED DESCRIPTION OF THE INVENTION

This invention provides the user of a portable audio device, such as an MP3 player, with a slim, retractable means of storing "ear bud" style headphones, with the retracting mechanism and coil spring being contained within a slim fitting case. In addition to housing the ear buds, the case may provide an alternate jack for the use of a second set of headphones.

Figure 1:
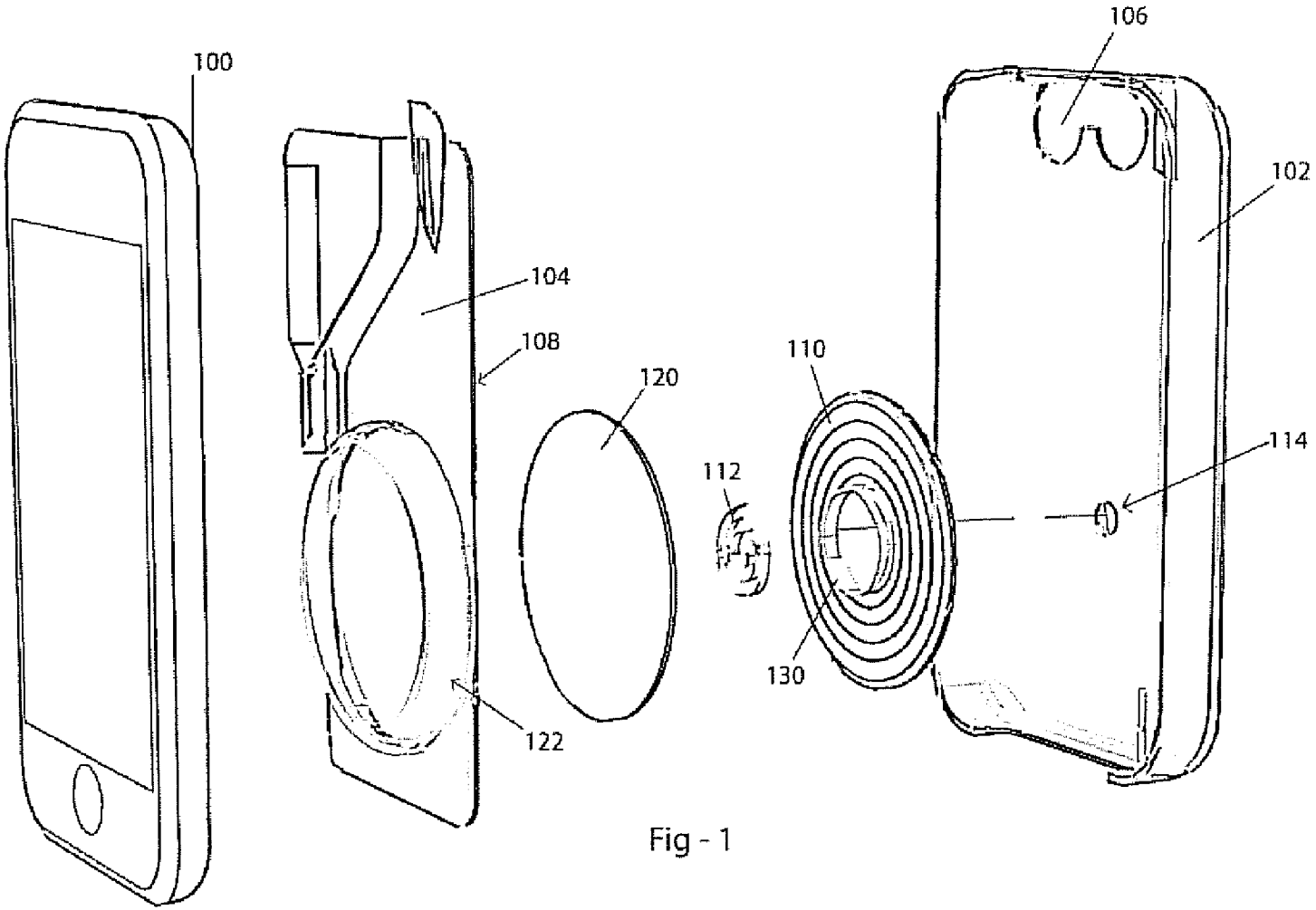
FIG. 1 is an exploded view of a preferred embodiment of the invention, but without the ear-buds and cords to better visualize the housing and retraction mechanism.

FIG. 1 is an exploded view of a preferred embodiment of the invention, but without the ear-buds and cords to better visualize the housing and retraction mechanism. The housing includes a outer shell piece 102 and an inner shell piece 104. The outer shell piece 102 includes an opening 106 with adjacent lobes into which the ear buds seat as explained in further detail below. The inner shell piece 104 has a peripheral shape corresponding to the inner periphery of the outer shell piece 102, such that the inner shell piece may be nested within the outer shell piece and cemented in position if necessary.

The cord for the ear-buds is wound on a spool 110. The spool 110 is biased with a coil spring 112 allowing the cord and ear-buds to be retracted into the housing during periods of non-use. The center portion of the spring 112 may be coupled to an externally accessible screw 114 enabling the spring to be tightened so that the cord and ear-buds are still fully retracted if spring tension diminishes over time. A plate 120 is positioned within a cup-shaped recess 122, the purpose of the plate being to keep the cord for the ear-buds wound on the spool 110 in an organized fashion.

Figure 2:
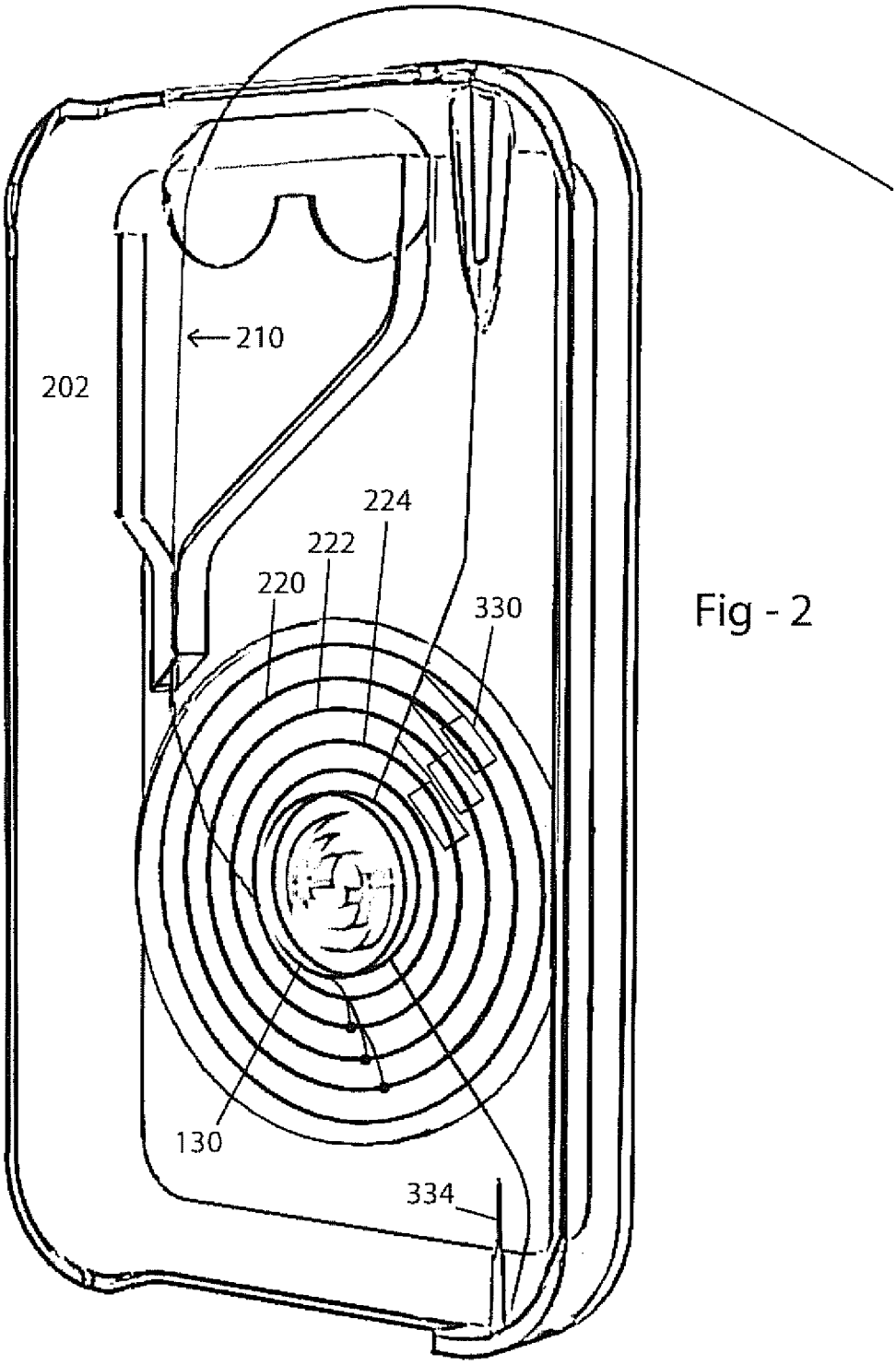
FIG. 2 is a perspective view of outer shell piece 102 better revealing other features of the invention.

FIG. 2 is a perspective view of outer shell piece 102 better revealing other features of the invention. Plastic partitions 202, 204 are provided to guide ear-bud cord 210 during extension and retraction. The spool 110 includes and inner ring 130 which provides a central form onto which the ear-bud cord is wound.

To make appropriate electrical connections, connection between the headphone jack and the rotating spool are preferably made through the use of at least three planar, concentric slip rings 220, 222, 224—one for ground, and the other two for right and left audio signals. The planar concentric slip rings are preferably incorporated into the disc surface which comprises one or both sides of the spool which coils the headphone wire or wires. The cord 210 for the ear-buds makes contact to the rings around or through the spool. A corresponding set of slip ring followers or contactors 330 makes contact to the slip rings to carry signals to conductor 332, 334, or both, one of which extends outwardly from the housing to plug into the music player, the other providing an optional jack for a supplementary set of headphones.

The outer diameter of the plate 120, and disk of spool 110, is on the order of 1 to 3 inches in diameter, depending upon the dimensions of the music player to which the housing is attached. The ring 130 is preferably less than 0.100" in thickness—only thick enough to contain the width of the headphone wires. The concentric planar slip rings are of a metallic nature, but deposited or incorporated onto a plastic or non-conductive disc which comprises part of the spool which coils the headphone wires.

The slip ring followers or contactors may be of a self-cleaning design so that a high quality electrical contact is maintained even after multiple extensions and retractions. The planar concentric slip rings and their associated contactors may have contacting surfaces which are of a precious metal or non-corrosive metal so as to maintain their high quality electrical contact for a good audio signal provided to the headphones or ear buds.

The coil spring 112 housed within the center portion of the spool around which the headphones are to be wound has a width which is preferably on the order of 0.100" (plus the thickness of the two discs which make up the sides of the spool). In the preferred embodiment, the coil spring has enough coils to permit enough rotation for an extraction of approximately 3 feet of wire for the headphone deployment. And further, the coil spring has enough coiled strength to maintain a retraction force on the ear bud wires of between 4 and 8 ounces. This provides adequate rotational force by which the cord is retracted into the casing. A spool, or drum, around which the cord is wrapped so as to provide the slimmest profile. The cord, either round, flat, or otherwise, is to be wrapped in a spiral fashion.

A button or switch may be provided to facilitate the extension or retraction of cord from the spool as well as set a desired length of cord for the user. The button or switch in the preferred embodiment allows for stopping and starting of the spool in any position by means of a brake or friction lever; or alternatively has multiple, discrete stopping positions (i.e., 5-10) in each revolution. The discrete stopping positions are enabled by corresponding catch positions on an escapement mechanism activated by the button and incorporated into the coiling spool mechanism.

An alternative means of securing a desired length of cord may also be provided through the use of a moveable or slideable cord-mounted device which may temporarily stop the retraction of the cord at desired lengths. The cord-mounted device may have a central hole through which the ear bud wires pass and the hole is sufficiently tight and with sufficient friction to provide more than 8 ounces of effort to move the device from one position on the ear bud wires to another. In this way, the cord-mounted device has a greater retention force on the wires than the retraction force of the spool.

The cord-mounted device is preferably narrow enough in thickness to be able to coil on the spool, but is large enough in its height dimension to be able to fit or jam into an anti-retraction gate which is connected to the retraction hole for the ear bud wire. In this way, the wires may be extracted from their spool to a desired length and then the wire with the cord-mounted device is guided into the anti-retraction gate to prevent retraction at the desired position.

Alternatively, the cord-mounted device may have flexible "wings" which deploy outward when the device is extracted from the coiled position. When the wings are deployed outward, they prevent the device from passing through the extraction hole for the ear bud wires. The wings of the cord-mounted device may be plastic and may function in a "living hinge" manner while being a single integral molded part with the cord mounted device.

Figure 3:
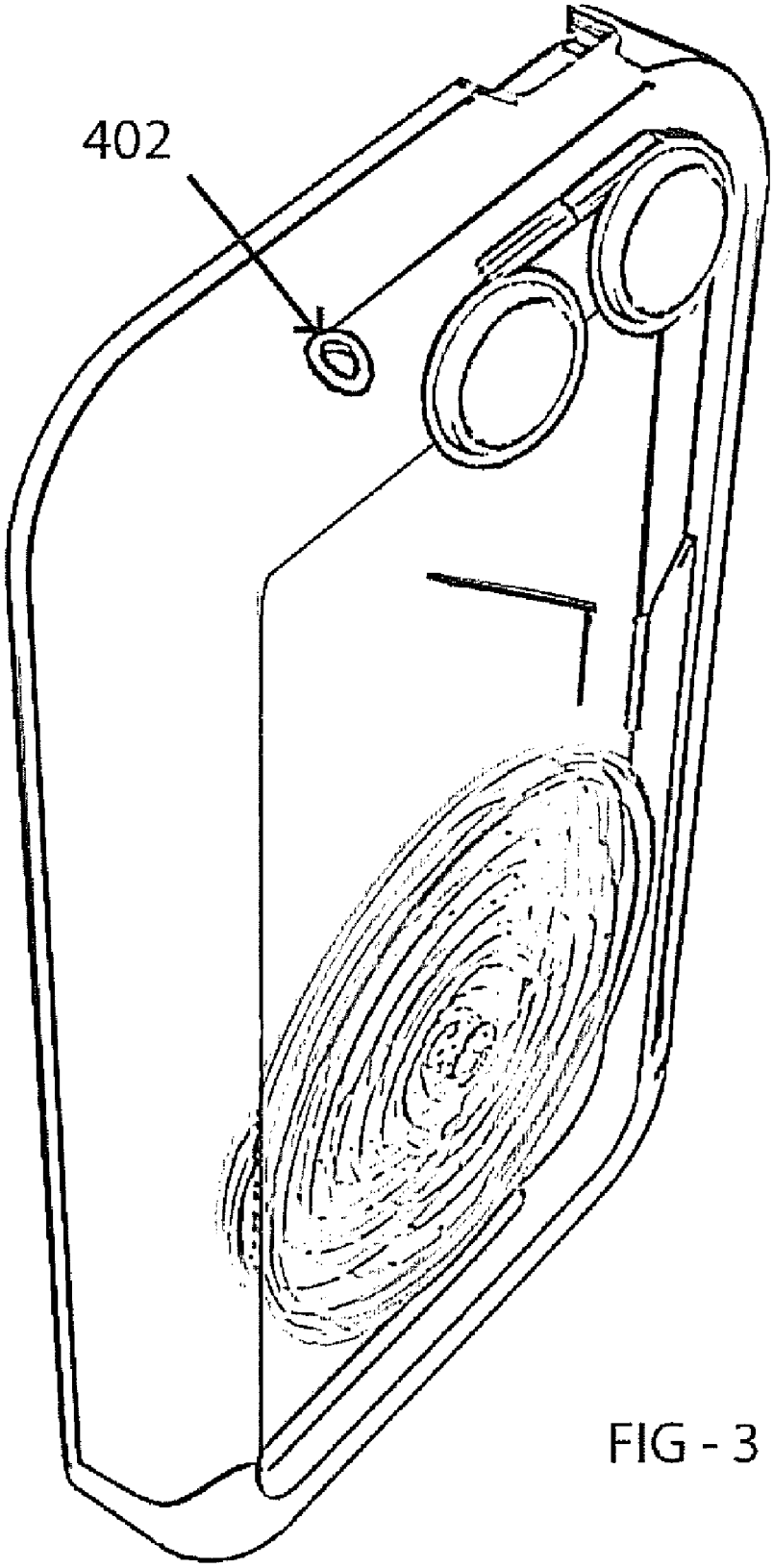
FIG. 3 is a perspective view of the preferred embodiment of the invention coupled to an MP3 type music player.

Referring to FIG. 3, as mentioned a port or jack 402 may provide an additional set of inputs, such as a second set of headphones. If the housing is mounted on an existing player, one wall of the housing may be eliminated in favor of the outer surface of the player, thereby further maintaining a slim profile. Although the plastic parts are shown as transparent, translucent and/or colored pieces may be used.

We claim:

1. A low-profile, retractable ear-bud system adapted for attachment to an existing portable electronic device having a peripheral outline and an audio output, comprising:

a housing having a peripheral edge corresponding to the peripheral outline of the portable electronic device, thereby enabling the housing to be mounted onto the portable electronic device;

wiring having a proximal end adapted for electrical connection to the audio output of the portable electronic device and a distal end terminating in a pair of ear-buds; and a spring-biased spool upon which the wiring is wound, the spool having at least a retracted position for storage of the ear-buds and an extended position for use of the ear-buds.

2. The ear-bud system of claim 1, wherein the proximal end of the wiring is in electrical communication with the portable electronic device through a multi-conductor slip ring.

3. The ear-bud system of claim 1, wherein the wiring is wound on the spring-biased spool in a single pancake-style layer.

4. The ear-bud system of claim 1, wherein the housing uses a surface of the portable electronic device as a housing wall to achieve a slim profile.

5. A low-profile, retractable ear-bud system adapted for attachment to an existing portable electronic device having a peripheral outline and an audio output, comprising:

a housing having a peripheral edge corresponding to the peripheral outline of the portable electronic device, thereby enabling the housing to be mounted onto the portable electronic device;

wiring having a proximal end adapted for electrical connection to the portable electronic device and a distal end terminating in a pair of ear-buds;

a spring-biased spool upon which the wiring is wound, the spool having at least a retracted position for storage of the ear buds and an extended position for use of the ear-buds; and wherein the wiring on the spool is in electrical communication with the proximal end of the wiring through a multi-conductor slip ring.

6. The ear-bud system of claim 5, wherein the wiring is wound on the spring-biased spool in a single pancake-style layer.

7. The ear-bud system of claim 5, wherein the housing uses a surface of the portable electronic device as a housing wall to achieve a slim profile.

* * * * *